US007915979B2

(12) United States Patent
Chang et al.

(10) Patent No.: US 7,915,979 B2
(45) Date of Patent: Mar. 29, 2011

(54) SWITCHABLE FREQUENCY RESPONSE MICROWAVE FILTER

(75) Inventors: Sheng-Fuh Chang, Min-Hsiung Township, Chiayi County (TW); Yi-Ming Chen, Hsinchu (TW); Cheng-Yu Chou, Taipei (TW)

(73) Assignee: National Chung Cheng University, Chia-Yi (TW)

( * ) Notice: Subject to any disclaimer, the term of this patent is extended or adjusted under 35 U.S.C. 154(b) by 372 days.

(21) Appl. No.: 12/178,703

(22) Filed: Jul. 24, 2008

(65) Prior Publication Data

US 2009/0256654 A1 Oct. 15, 2009

(30) Foreign Application Priority Data

Apr. 15, 2008 (TW) ..... 97113618 A

(51) Int. Cl.
*H01P 1/203* (2006.01)
*H01P 7/08* (2006.01)

(52) U.S. Cl. ..... 333/205; 333/235

(58) Field of Classification Search ..... 333/175, 333/176, 185, 202, 204–212, 221–223, 231, 333/235

See application file for complete search history.

(56) References Cited

U.S. PATENT DOCUMENTS 5,406,238 A * 4/1995 Suzuki ..... 333/219
5,659,274 A * 8/1997 Takahashi et al. ..... 333/204

OTHER PUBLICATIONS

L. Dussopt and G. Rebeiz, "Intermodulation distortion and power handling in RF MEMS switches, varactors and tunable filters," IEEE Trans. Microw. Theory Tech., vol. 51, No., 2003.

K. Entesari and G. Rebeiz, "A 12-18-Ghz three-pole RF MEMS tunable filter," IEEE Trans. Microw. Theory Tech., vol. 53, No. 8, pp. 2566-2571, Aug. 2005.

S. J. Park, K. Y. Lee, G. Rebeiz, "Low-loss 5.15-5.70-GHz RF MEMS switchable filter for wireless Lan applications," IEEE Trans. Microw. Theory Tech., vol. 54, No. 11, pp., 2006.

C. T. C. Nguyen, "Intergrated micromechanical circuits for RF front ends," in Proc. European Solid-State Circuits Conference, Sep. 2006, pp. 7-16.

W. D. Yan, R. R. Mansour, "Tunable dielectric resonator bandpass filter with ebedded MEMS tuning elements", IEEE Trans. Microw. Theory Tech., vol. 55, No. 1, pp. 154-160, 2006.

J. H. Park, S. Lee, J. M. Kim, H. T. Kim, Y. Kwon, Y. K. Kim, Reconfigurable millimeter-wave filters using CPW-based periodic structures with novel multiple-contact MEMS, 2005.

M. Makimoto and M. Sagawa, "Varactor tuned bandpass filters using microstrip-line ring resonators," in IEEE MTT-S Int. Microwave Symp. Dig., Jun. 2, 1986, pp. 411-414.

C. Lugo and J. Papapolymerou, "Dual-mode reconfigurable filter with asymmetrical transmission zeros and center frequency control," IEEE Microw. and Wireless Components Let, 2006.

I. Awai, "General theory of a circular dual-mode resonator and filter," IEICE Trans. Electron., vol. E81-C, No. 1, pp. 1575-1763, Nov. 1998.

(Continued)

*Primary Examiner* — Benny Lee
*Assistant Examiner* — Gerald Stevens
(74) *Attorney, Agent, or Firm* — Ming Chow; Sinorica, LLC

(57) ABSTRACT

The present invention discloses a switchable frequency response microwave filter, which uses voltage-controlled varactors to attain the separation or combination of the odd mode and even mode of signals in a dual-mode ring resonator to realize a bandpass or bandstop function and then controls the frequency response of the output filtered signals. Further, the present invention integrates different circuit architectures having bandpass and bandstop functions into a single circuit to reduce the complexity of the circuit.

20 Claims, 17 Drawing Sheets

OTHER PUBLICATIONS

B. T. Tan, S. T. Chew, M. S. Leong, and Ooi, "A dual-mode bandpass filter with enhanced capacitive perturbation," Trans. Microw. Theory Tech., vol. 51, No. 8 pp. 1906-1910, 2003.

M. F. Lei and H. Wang, "An analysis of miniaturized dual-mode bandpass filter structure using shunt capacitance perturbation," IEEE Trans. Microw. Theory Tech., vol. 53, 2005.

A. Görür, Description of coupling between degenerate modes of a dual-mode microstrip loop resonator using a novel perturbation arrangement and its dual-mode bandpass fi, 2004.

H. Yabuki, M. Sagawa, M. Matsuo, and M. Makimoto, "Stripline dual-mode ring resonators and their applications to microwave devices," IEEE Trans. Microw. Theory Tech., vo, 1996.

M. Matsuo, H. Yabuki, and M. Makimoto, "Dual-mode stepped-impedance ring resonator for bandpass filter applications," IEEE Trans. Microw. Theory Tech., vol. 49, No. 7 pp, 2001.

S. W. Fok, P. Cheong, K. W. Tam and R. P. Martins, A novel microstrip square-loop dual-mode bandpass filter with simultaneous size reduction and spurious response suppr, 2006.

J. T. Kuo and C. Y. Tsai, "Periodic stepped-impedance ring resonator(PSIRR) bandpass filter with miniaturized area and desirable upper stopband characteristics," IEEE Tr, 2006.

Y. H. Jeng, S. F. Chang, Y. M. Chen, and Y. J. Huang, "A novel self-coupled dual-mode ring resonator and its applications to bandpass filters," IEEE Trans. Microw. Theor, 2006.

* cited by examiner

SWITCHABLE FREQUENCY RESPONSE MICROWAVE FILTER

BACKGROUND OF THE INVENTION

1. Field of the Invention

The present invention relates to a microwave filter, particularly to a switchable frequency response microwave filter.

2. Description of the Related Art

The filter plays an important role in wireless communication. When the frequency of a signal is at the bandpass region of the filter, the signal is allowed to pass. When the frequency of a signal is at the bandstop region of the filter, the signal is attenuated. In other words, the filter controls the response of a communication system around a certain frequency.

Generally, filters are classified into high pass filters, low pass filters, bandpass filters and bandstop filters, which respectively have different circuit architectures. Therefore, only via adjusting bandwidth or changing the center frequency can signal attenuation be achieved in a single circuit architecture. However, circuit designers sometimes cannot attain the desired filtered signal merely via adjusting bandwidth or changing the center frequency but have to use filters of other circuit architectures. For example, a bandpass filter allows medium-frequency signals to pass but intercepts high-frequency signals and low-frequency signals. It is impossible for a bandpass filter to intercept medium-frequency signals but allow high-frequency signals and low-frequency signals to pass because high-frequency signals and low-frequency signals have opposite frequency response in a bandpass filter. When two different frequency responses are needed, two independent filter structures are usually adopted, and a control circuit is used to shift the signal path from a filter structure to another filter structure. However, such a design has the disadvantages of a complicated circuit and an increased circuit area.

For overcoming the abovementioned conventional problems, the present invention proposes a switchable frequency response microwave filter, which can switch between a bandpass frequency response and a bandstop frequency response, wherein totally replacing the circuit architecture is unnecessary, and the complexity of the conventional circuit is reduced, and the circuit area is decreased.

SUMMARY OF THE INVENTION

The primary objective of the present invention is to provide a switchable frequency response microwave filter, which can switch between a bandpass frequency response and a bandstop frequency response without totally replacing the circuit architecture.

Another objective of the present invention is to provide a switchable frequency response microwave filter, which integrates both circuit architectures of a bandpass filter and a bandstop filter into a single circuit to reduce the complexity of the circuit.

Further objective of the present invention is to provide a switchable frequency response microwave filter, which can switch between a bandpass frequency response and a bandstop frequency response, wherein the two frequency responses have an identical center frequency.

To achieve the abovementioned objectives, the present invention proposes a switchable frequency response microwave filter, which comprises: a signal input electrode receiving an external signal, which is to be processed; an input voltage-controlled varactor coupled to the signal input electrode and a first voltage source; a dual-mode ring resonator coupled to the input voltage-controlled varactor, a grounding terminal and a second voltage source and receiving the signals via the input voltage-controlled varactor; a set of perturbing voltage-controlled varactors connected with the dual-mode ring resonator; an output voltage-controlled varactor coupled to the dual-mode ring resonator; and a signal output electrode coupled to the output voltage-controlled varactor and the grounding terminal. The output voltage-controlled varactor transfers the signal from the dual-mode ring resonator to the signal output electrode so as to output a filtered signal. The two voltage sources are used to modulate the perturbing voltage-controlled varactors, whereby the phase velocities of the even mode and odd mode of the signal are controlled in the dual-mode ring resonator. Thereby, the frequency response of the filtered signal is controlled. The center frequencies of the bandpass and bandstop responses are expressed by the following two equations:

$$f_{c,BP}=f_u\{1-(1/\pi)\tan^{-1}(x_S/2)+(1/2\pi)[x_F/(1+x_F^2)]Z_R/Z_O\}$$

$$f_{c,BS}=f_u\{1+(1/2\pi)[x_F/(1+x_F^2)]Z_R/Z_O\}.$$

In the present invention, the capacitances of the input voltage-controlled varactor and output voltage-controlled varactor can be used to influence the center frequencies of the bandpass and bandstop responses, and the frequency shift of the center frequencies of the two responses can be improved via careful calculation.

Below, the preferred embodiments will be described in detail in cooperation with the drawings to make easily understood the characteristics and accomplishments of the present invention.

DETAILED DESCRIPTION OF THE INVENTION

Figure 1:
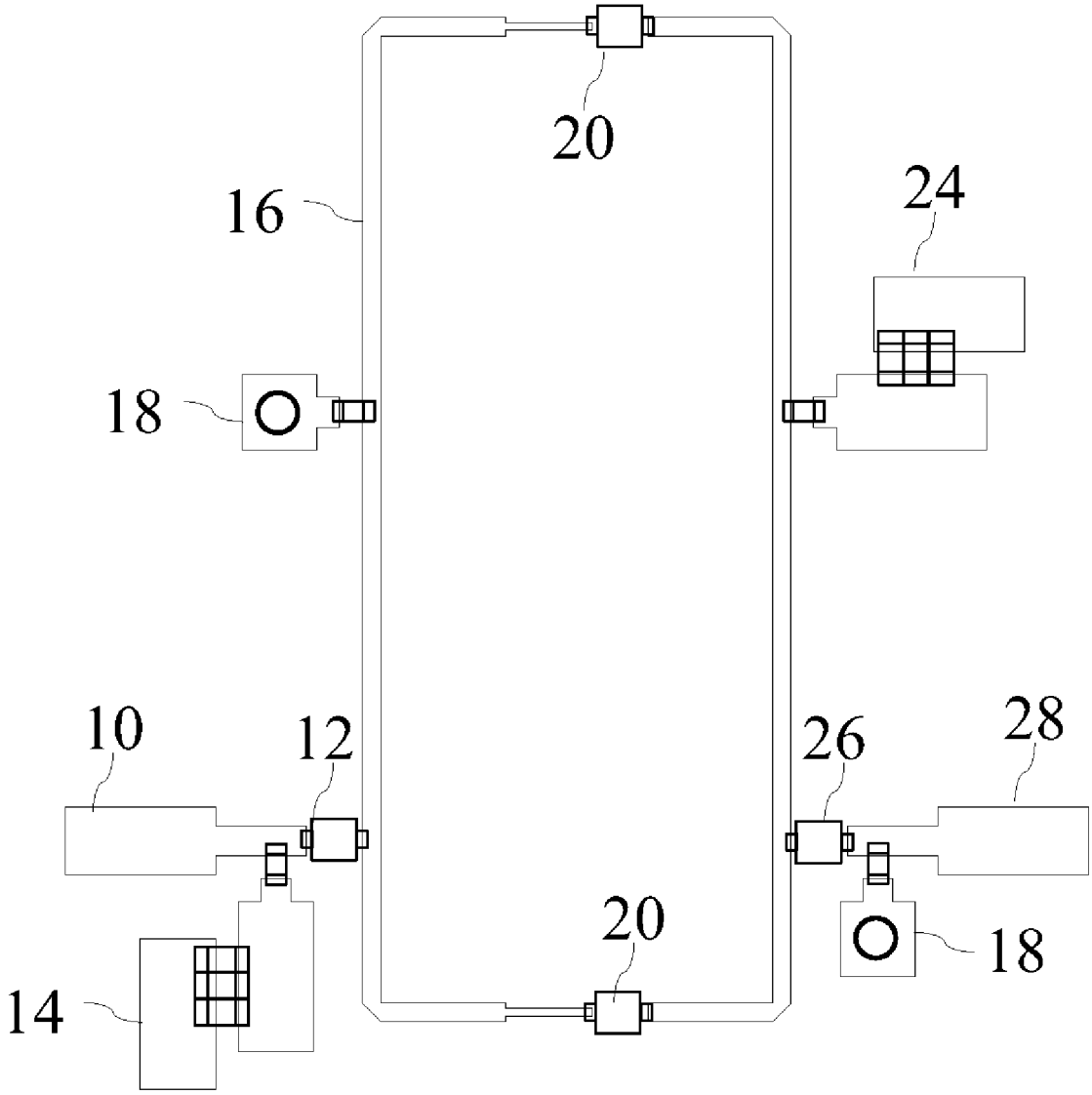
FIG. 1 is a diagram schematically showing the structure of a microwave filter according to the present invention.
Figure 2A:
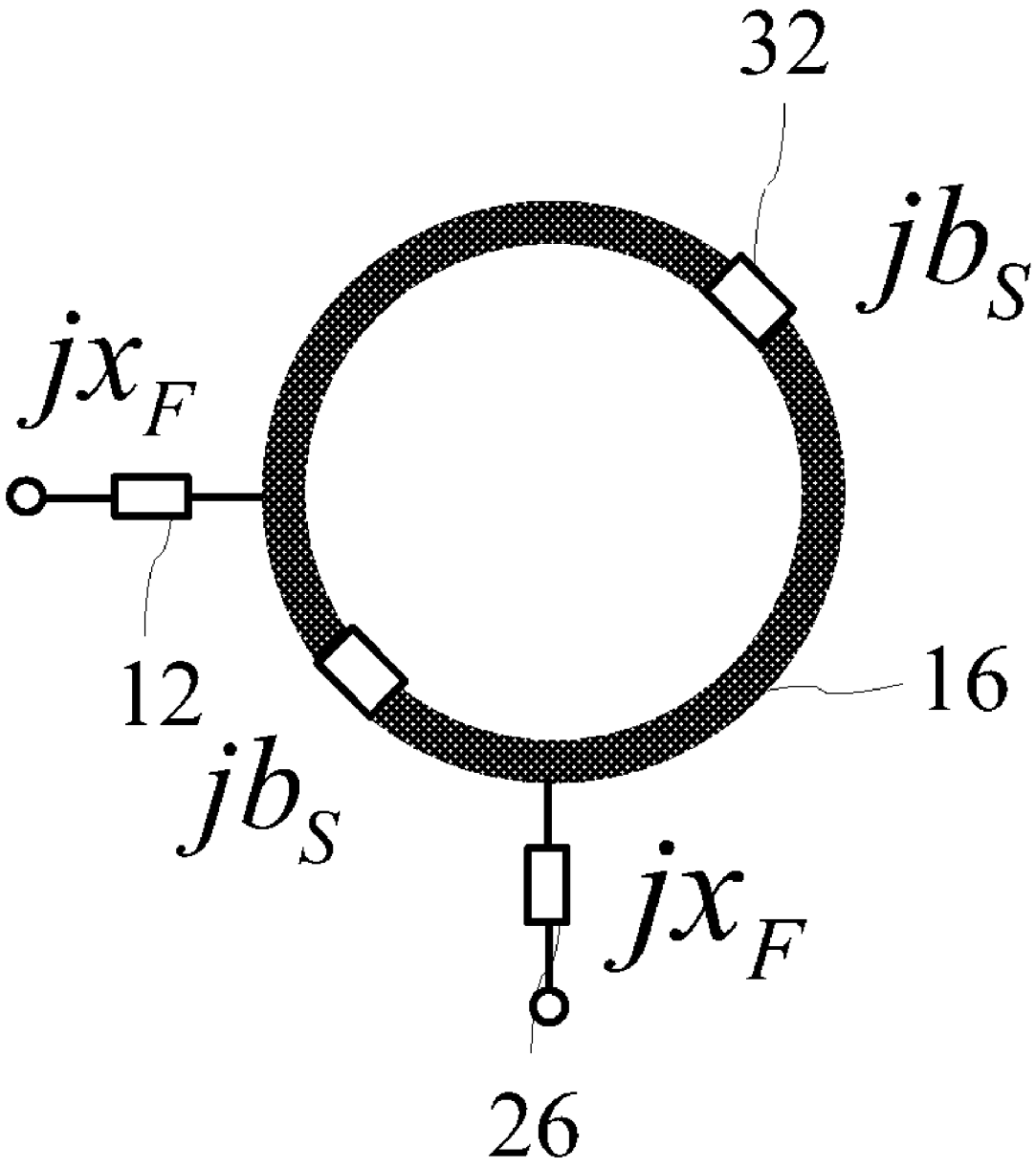
FIG. 2(*a*) to FIG. 2(*n*) are diagrams schematically showing the arrangements of the perturbing voltage-controlled varactors according to the present invention.
Figure 2B:
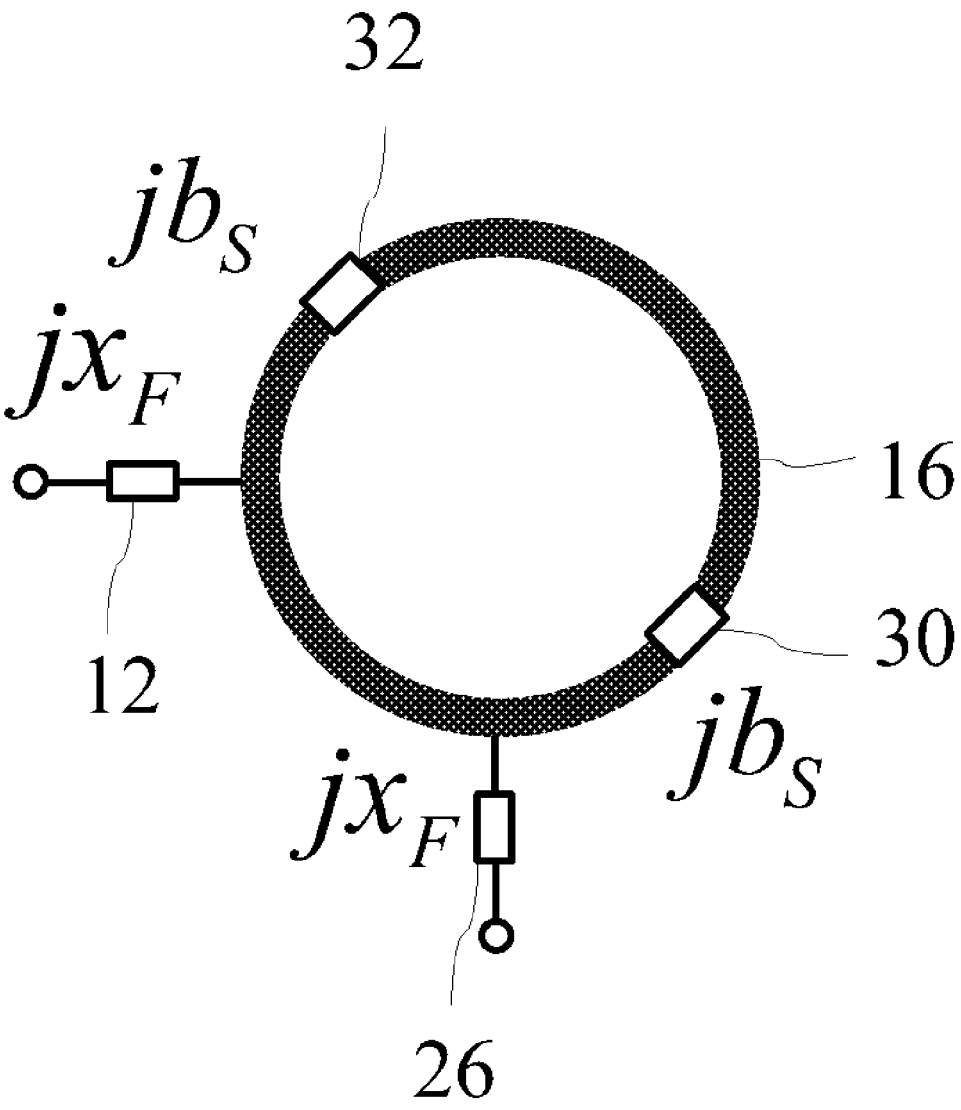
Figure 2C:
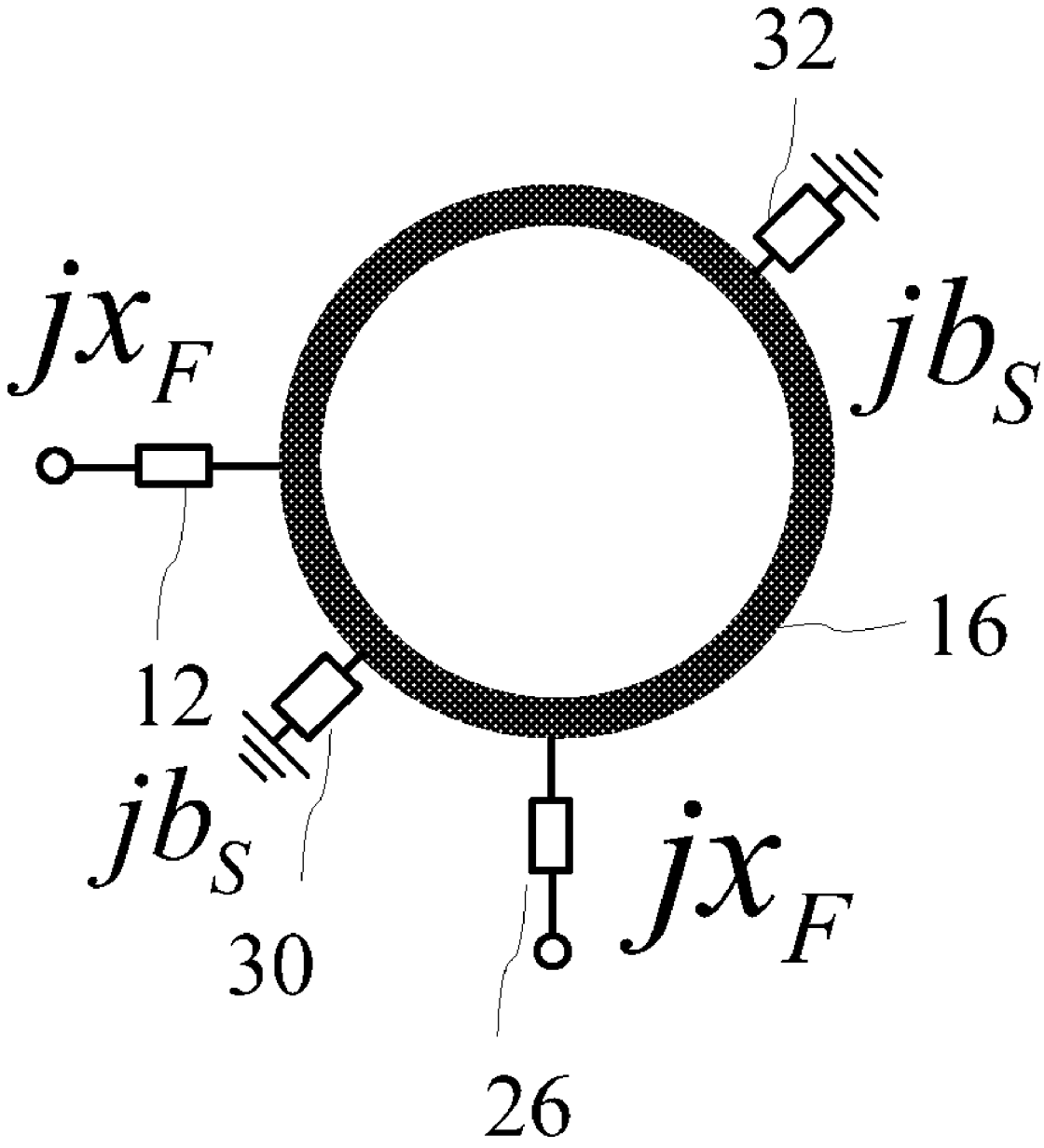
Figure 2D:
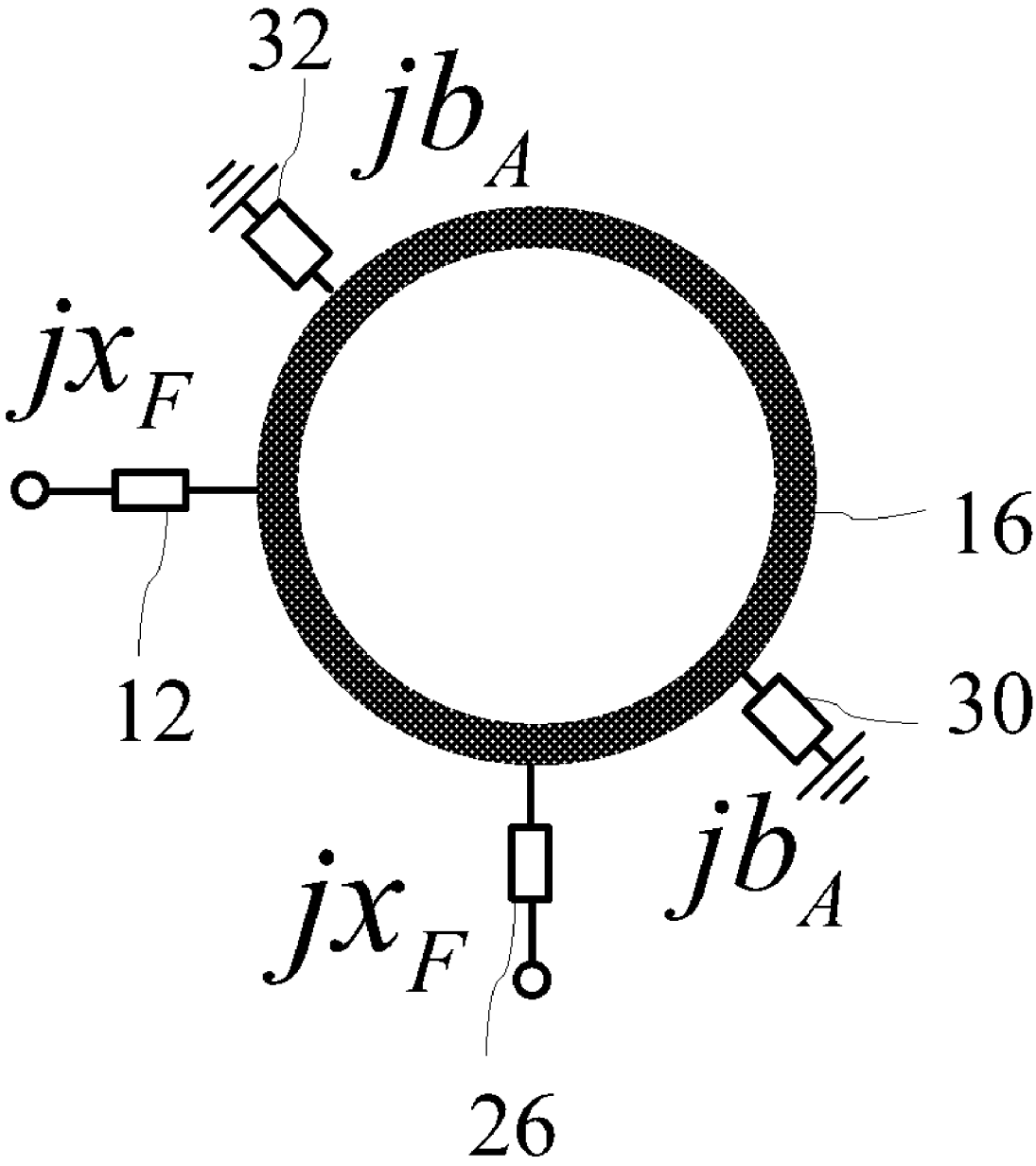
Figure 2E:
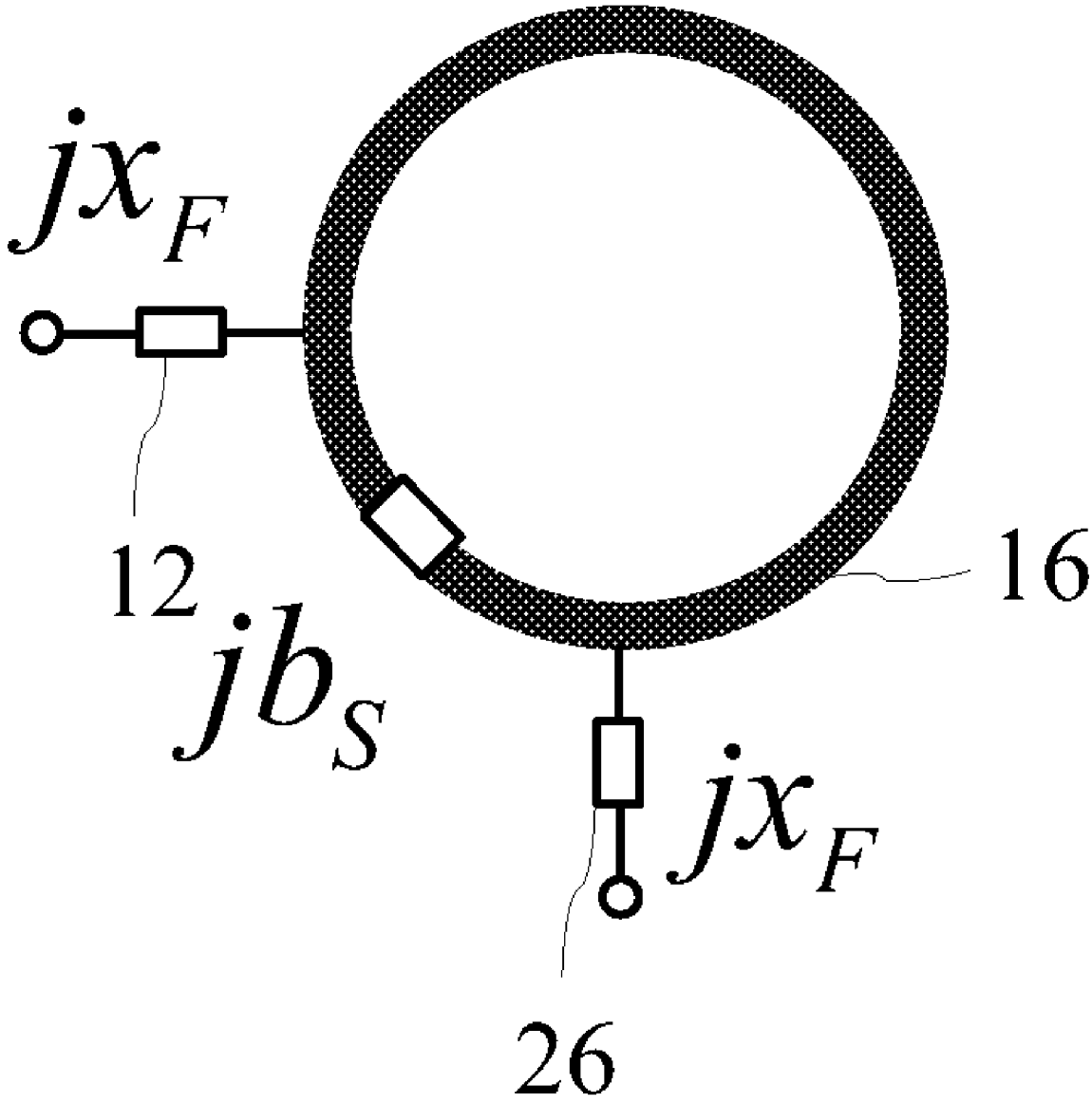
Figure 2F:
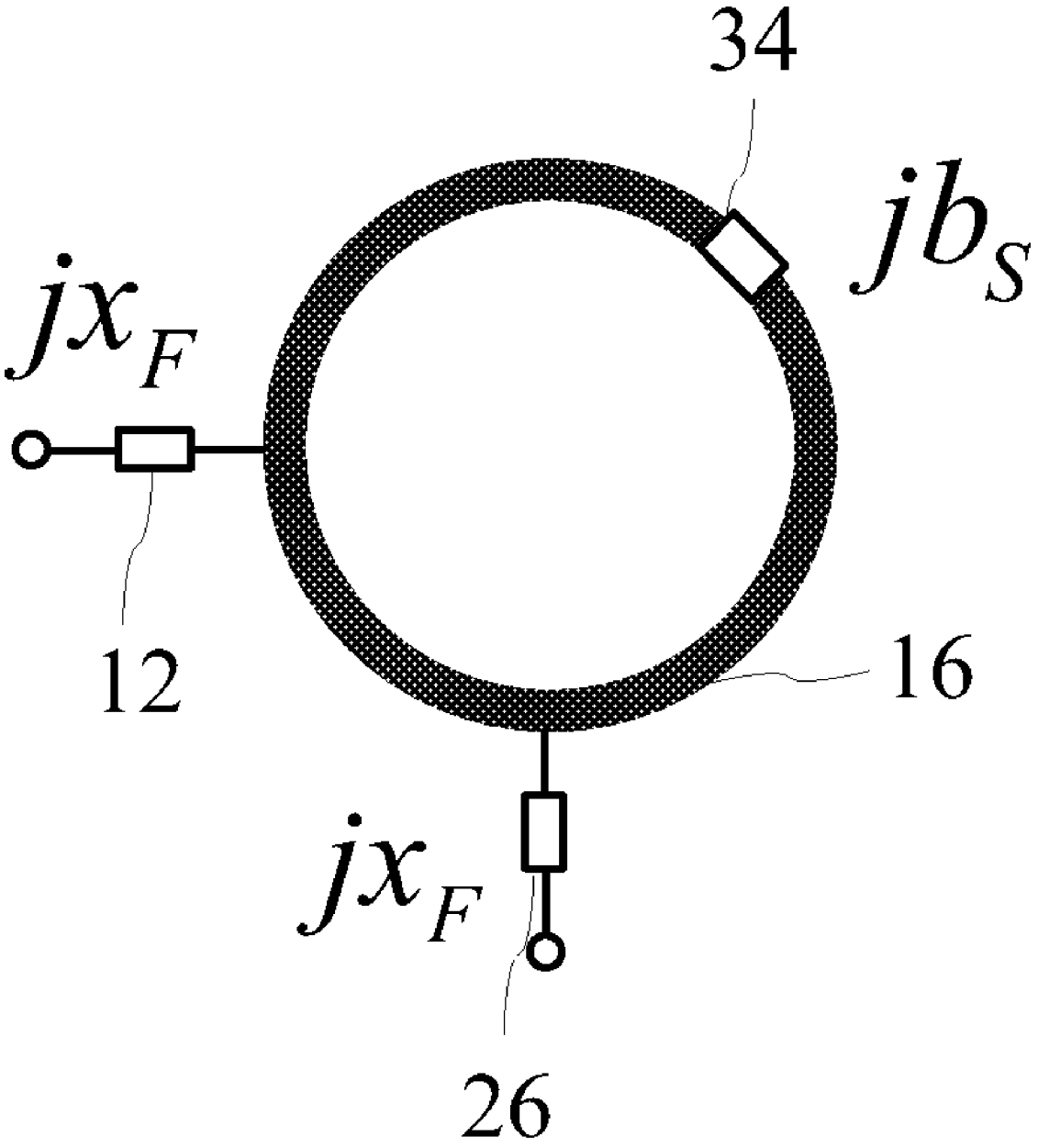
Figure 2G:
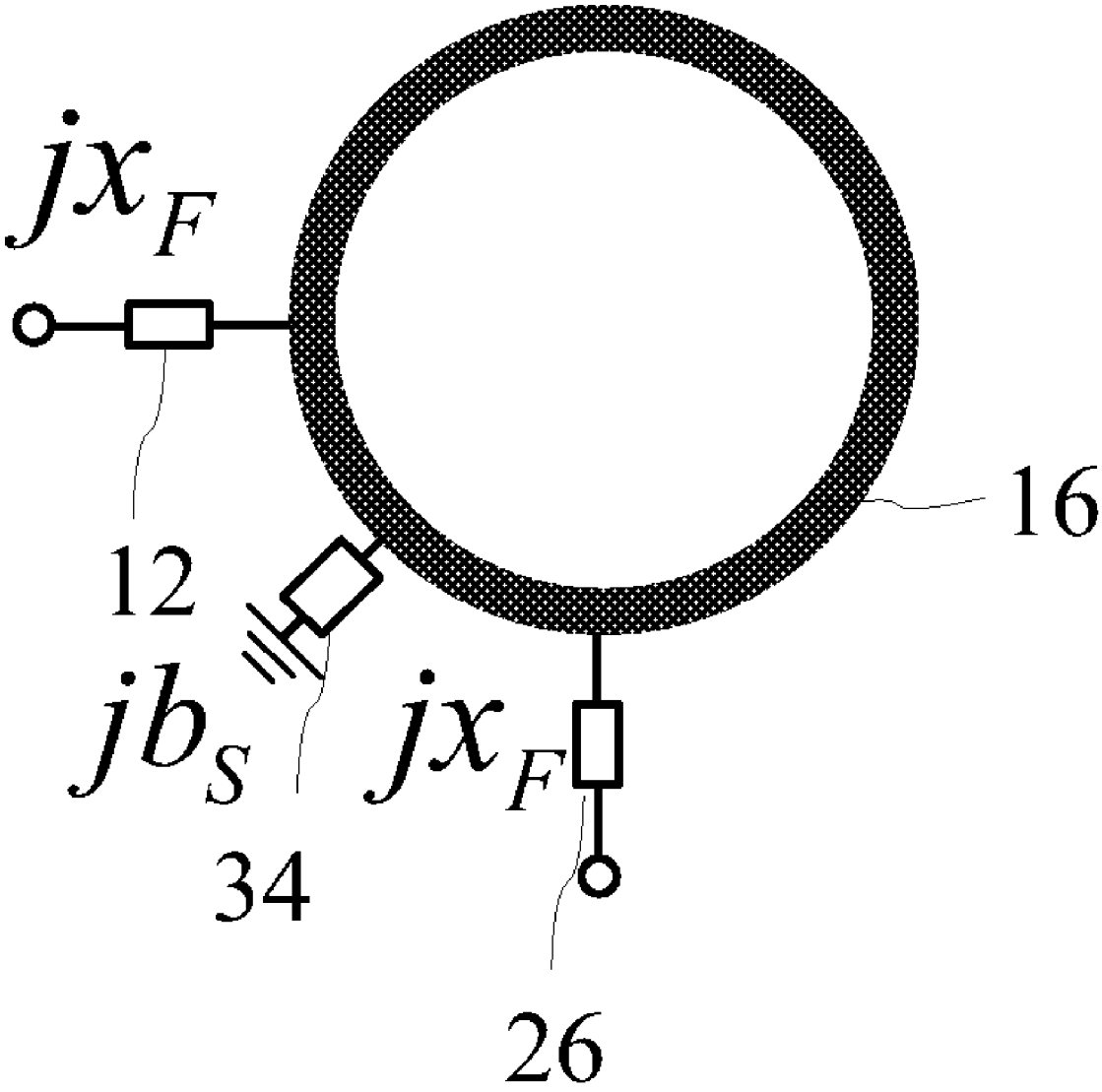
Figure 2H:
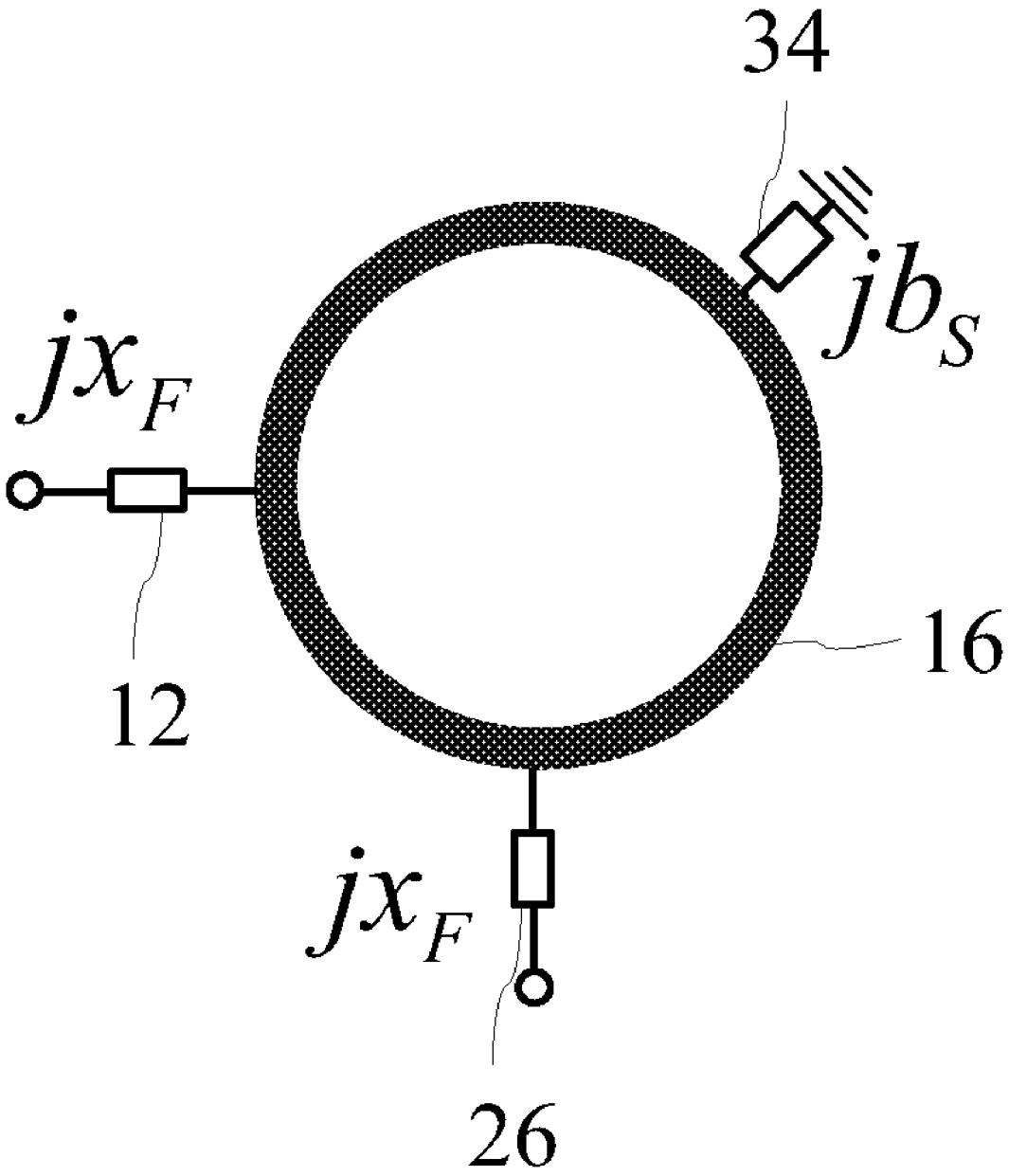
Figure 2I:
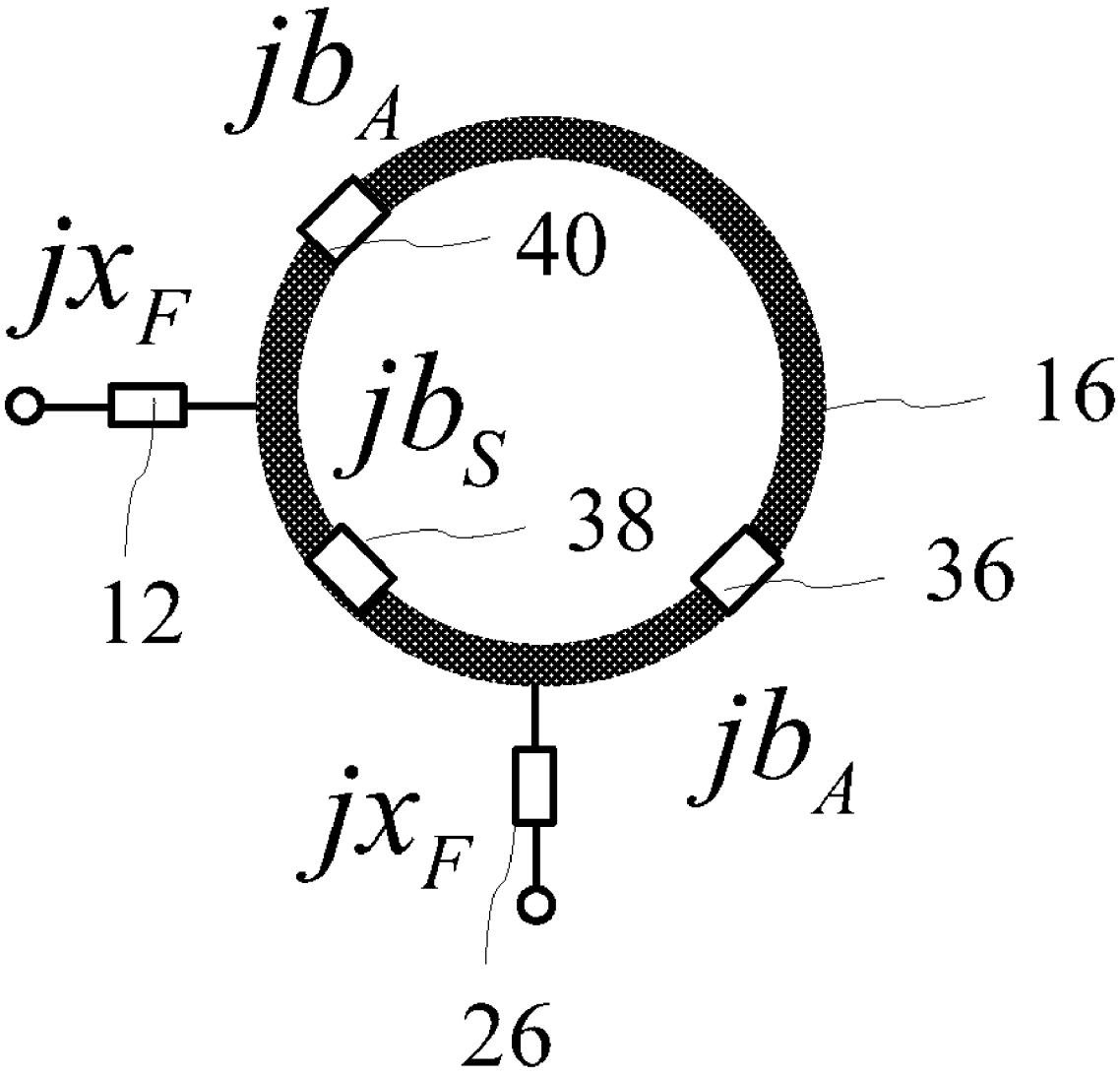
Figure 2J:
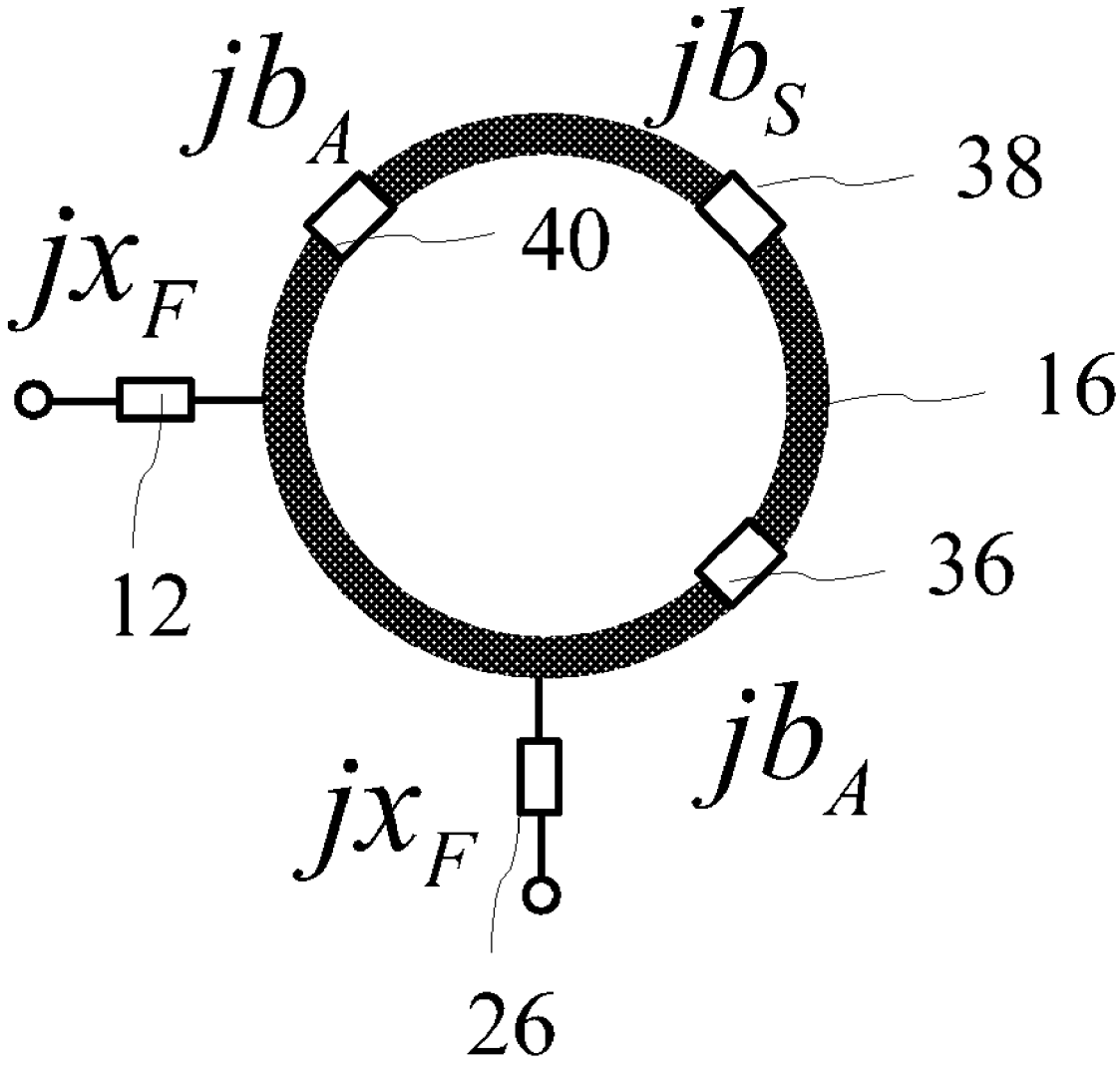
Figure 2K:
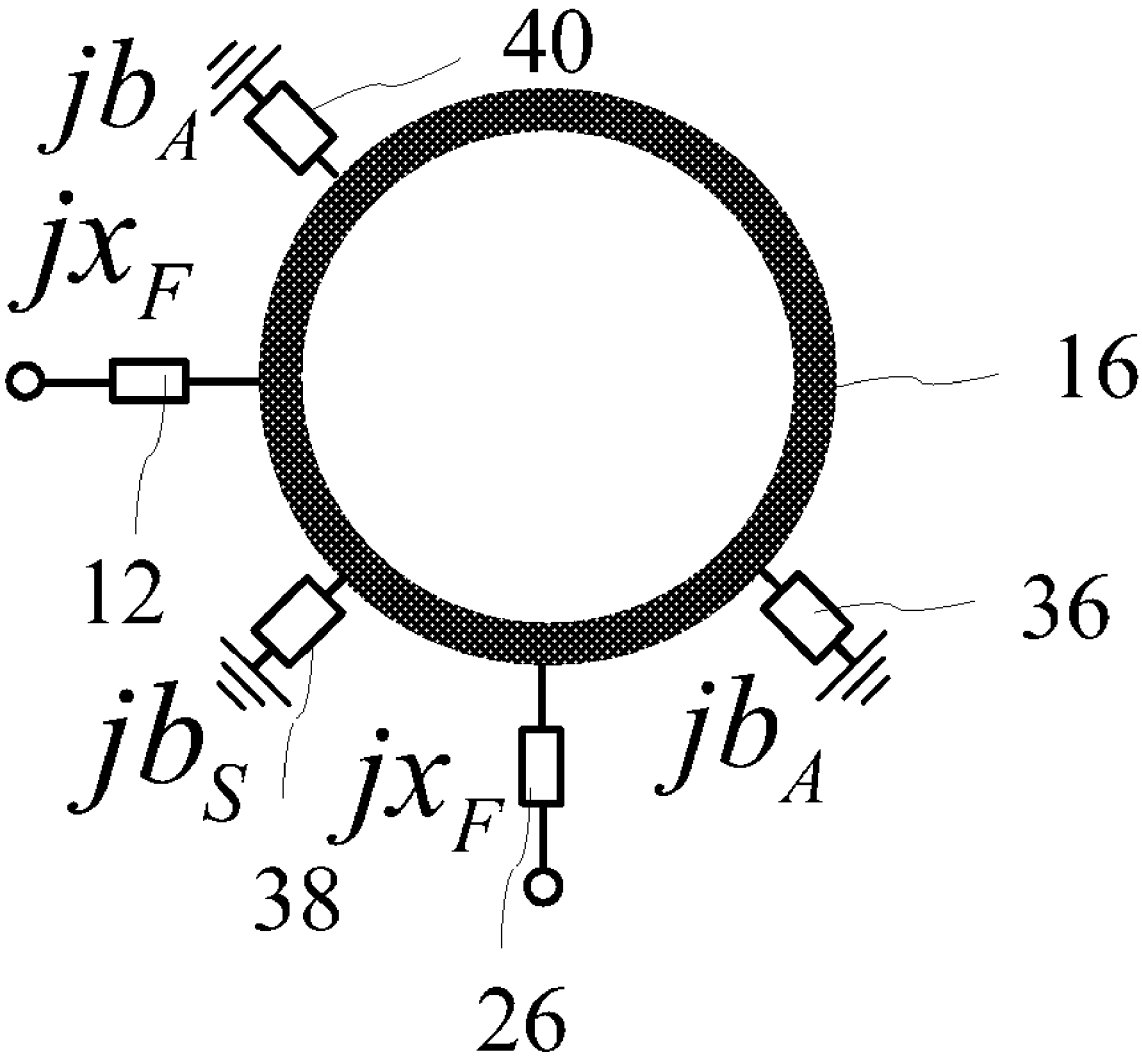
Figure 2L:
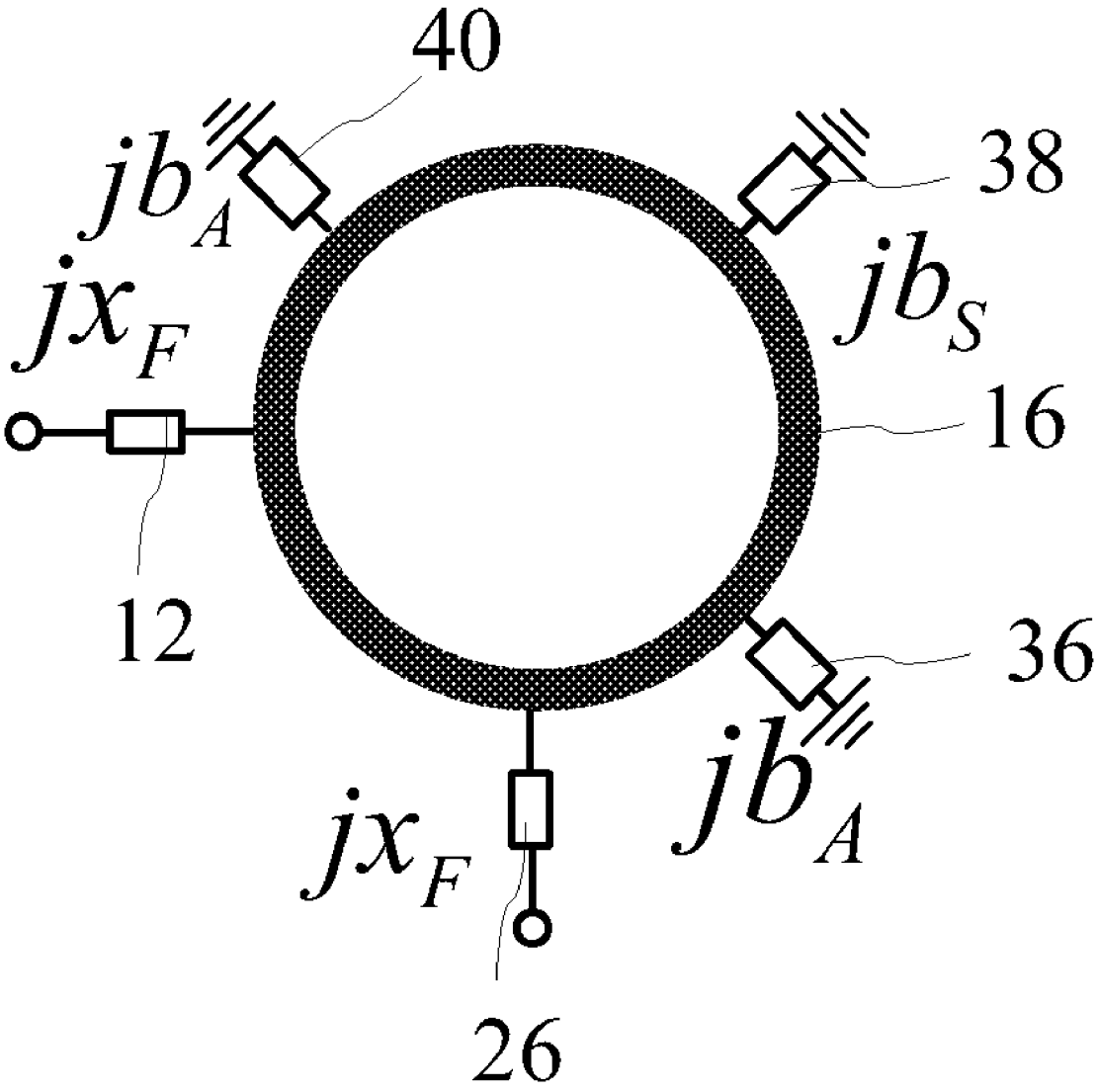
Figure 2M:
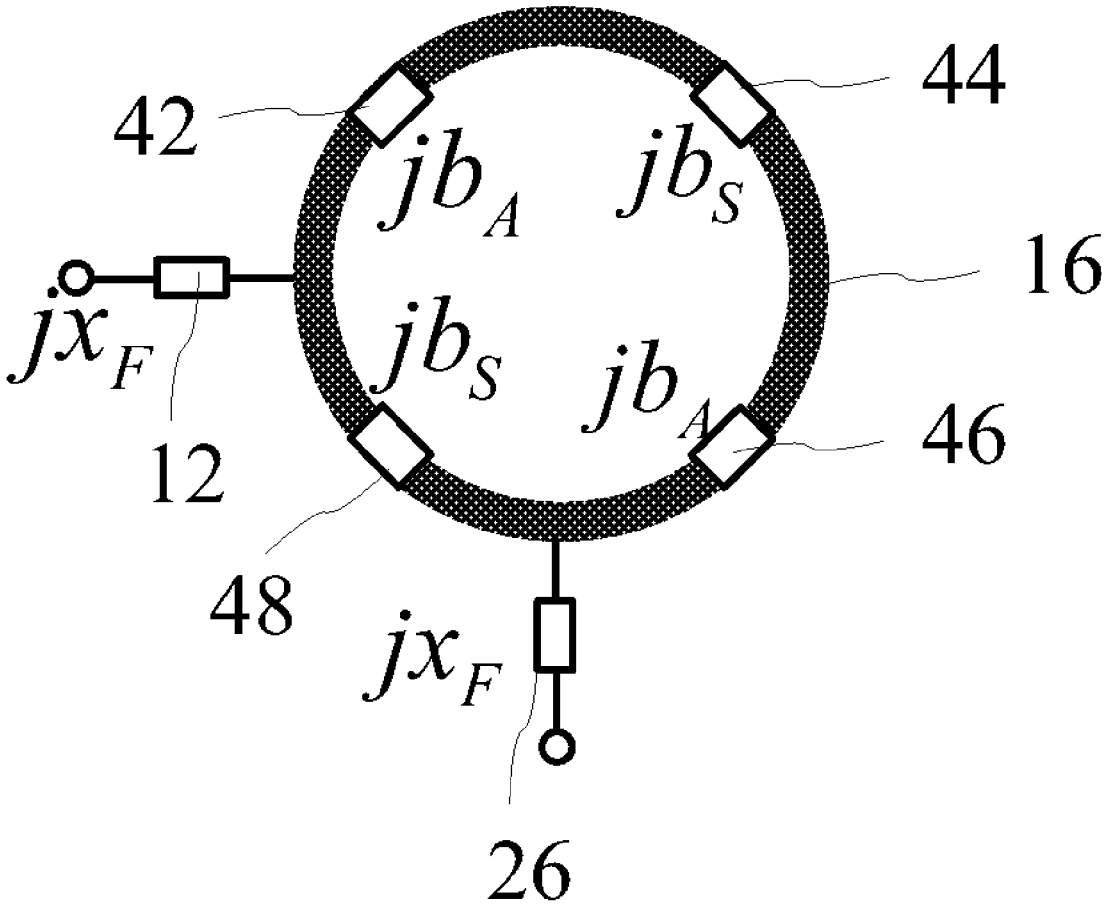
Figure 2N:
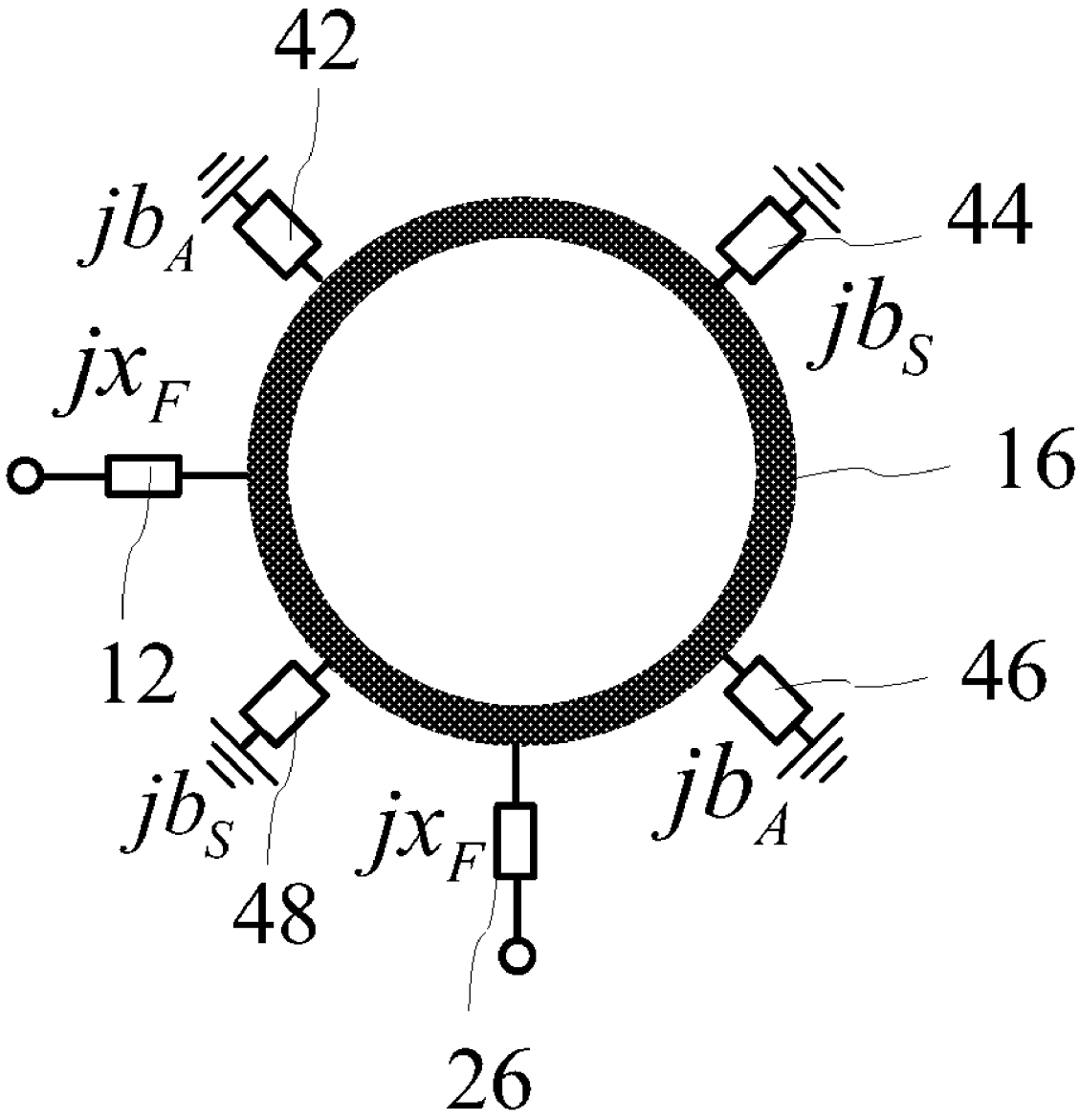

Refer to FIG. 1 a diagram schematically showing the structure of a microwave filter according to the present invention. The microwave filter of the present invention comprises: a signal input electrode 10 receiving an external signal, which is to be processed; an input voltage-controlled varactor 12 coupled to the signal input electrode 10 and a first voltage source 14; a dual-mode ring resonator 16 coupled to the input voltage-controlled varactor 12, a grounding terminal 18 and a second voltage source 24; two perturbing voltage-controlled varactors 20 respectively arranged in different positions of the dual-mode ring resonator 16, wherein two ends of each perturbing voltage-controlled varactor 20 are connected with the dual-mode ring resonator 16; an output voltage-controlled varactor 26 coupled to the dual-mode ring resonator 16; and a signal output electrode 28 coupled to the output voltage-controlled varactor 26 and the grounding terminal 18. The output voltage-controlled varactor 26 transfers the signal from the dual-mode ring resonator 16 to the signal output electrode 28 so as to output a filtered signal. The two voltage sources 14 and 24 are used to modulate the two perturbing voltage-controlled varactors 20, the input voltage-controlled varactor 12 and the output voltage-controlled varactor 26, whereby the phase velocities of the even mode and odd mode of the signal are controlled in the dual-mode ring resonator 16. Thus, the frequency response of the filtered signal is controlled. In the present invention, the dual-mode ring resonator 16 is formed of a transmission line, and the transmission line may be a strip line, a microstrip line, two open conductive lines, a coaxial cable, a slotted line, a square waveguide, a round waveguide, or a coplanar waveguide.

Refer to FIG. 2(*a*). The positions where the voltage-controlled varactors are arranged are related to the phases of signals. In this embodiment, the signal phases in the input voltage-controlled varactor 12 and output voltage-controlled varactor 26 have a phase difference of 90 degrees; the signal phase in a perturbing voltage-controlled varactor 30 respectively has a phase difference of 45 degrees with respect to the signal phases in the input voltage-controlled varactor 12 and the output voltage-controlled varactor 26; the signal phase in a perturbing voltage-controlled varactor 32 respectively has a phase difference of 135 degrees with respect to the signal phases of the input voltage-controlled varactor 12 and the output voltage-controlled varactor 26, and the signal phases in the perturbing voltage-controlled varactors 30 and 32 have a phase difference of 180 degrees. Refer to FIG. 2(*b*). In this embodiment, the signal phase in a perturbing voltage-controlled varactor 32 has a phase difference of 45 degrees with respect to the signal phase in the input voltage-controlled varactor 12; the signal phase in a perturbing voltage-controlled varactor 30 has a phase difference of 45 degrees with respect to the signal phase in the input voltage-controlled varactor 26; and the signal phases in the perturbing voltage-controlled varactors 30 and 32 have a phase difference of 180 degrees. In the embodiments shown in FIG. 2(*a*) and FIG. 2(*b*), the two perturbing voltage-controlled varactors 30 and 32 are in series. In other words, two ends of each of the perturbing voltage-controlled varactors 30 and 32 are connected to the dual-mode ring resonator 16. Refer to FIG. 2(*c*) and FIG. 2(*d*), wherein the two perturbing voltage-controlled varactors 30 and 32 are in parallel, and wherein one end of each of the perturbing voltage-controlled varactors 30 and 32 is connected to the dual-mode ring resonator 16, and the other end of each of the perturbing voltage-controlled varactors 30 and 32 is grounded.

Refer to FIG. 2(*e*), wherein only a single perturbing voltage-controlled varactor is used. In this embodiment, the signal phases in the input voltage-controlled varactor 12 and output voltage-controlled varactor 26 have a phase difference of 90 degrees; and the signal phase in a perturbing voltage-controlled varactor 34 respectively has a phase difference of 45 degrees with respect to the signal phases in the input voltage-controlled varactor 12 and the output voltage-controlled varactor 26. Refer to FIG. 2(*f*), wherein only a single perturbing voltage-controlled varactor is used also. In this embodiment, the signal phase in a perturbing voltage-controlled varactor 34 respectively has a phase difference of 135 degrees with respect to the signal phases in the input voltage-controlled varactor 12 and the output voltage-controlled varactor 26. In the embodiments shown in FIG. 2(*e*) and FIG. 2(*f*), the perturbing voltage-controlled varactors 34 is in series with the dual-mode ring resonator 16. In other words, two ends of the perturbing voltage-controlled varactor 34 are connected to the dual-mode ring resonator 16. Refer to FIG. 2(*g*) and FIG. 2(*h*), wherein the perturbing voltage-controlled varactors 34 is in parallel with the dual-mode ring resonator 16, and wherein one end of the perturbing voltage-controlled varactor 34 is connected to the dual-mode ring resonator 16, and the other end of the perturbing voltage-controlled varactor 34 is grounded.

Refer to FIG. 2(*i*), wherein three perturbing voltage-controlled varactors are used. In this embodiment, the signal phases in the input voltage-controlled varactor 12 and output voltage-controlled varactor 26 have a phase difference of 90 degrees; the signal phase in a perturbing voltage-controlled varactor 38 respectively has a phase difference of 45 degrees with respect to the signal phases in the input voltage-controlled varactor 12 and the output voltage-controlled varactor 26; the signal phase in a perturbing voltage-controlled varactor 40 has a phase difference of 45 degrees with respect to the signal phase in the input voltage-controlled varactor 12; the signal phase in the perturbing voltage-controlled varactor 36 has a phase difference of 45 degrees with respect to the signal phase in the output voltage-controlled varactor 26; and the signal phases in the perturbing voltage-controlled varactors 36 and 40 have a phase difference of 180 degrees. Refer to FIG. 20), wherein three perturbing voltage-controlled varactors are used also. In this embodiment, the signal phase in a perturbing voltage-controlled varactor 38 respectively has a phase difference of 135 degrees with respect to the signal phases of the input voltage-controlled varactor 12 and the output voltage-controlled varactor 26; the signal phase in a perturbing voltage-controlled varactor 40 has a phase difference of 45 degrees with respect to the signal phase in the input voltage-controlled varactor 12; the signal phase in a perturbing voltage-controlled varactor 36 has a phase difference of 45 degrees with respect to the signal phase in the output voltage-controlled varactor 26; and the signal phases in the perturbing voltage-controlled varactors 36 and 40 have a phase difference of 180 degrees. In the embodiments shown in FIG. 2(*i*) and FIG. 2(*j*), the perturbing voltage-controlled varactors are in series. In other words, two ends of each of the perturbing voltage-controlled varactors 36, 38 and 40 are connected to the dual-mode ring resonator 16. Refer to FIG. 2(*k*) and FIG. 2(*l*), wherein the three perturbing voltage-controlled varactors 36, 38 and 40 are in parallel, and wherein one end of each of the perturbing voltage-controlled varactors 36, 38 and 40 is connected to the dual-mode ring resonator 16, and the other end of each of the perturbing voltage-controlled varactors 36, 38 and 40 is grounded.

Refer to FIG. 2(*m*), wherein four perturbing voltage-controlled varactors are used. In this embodiment, the signal phases in the input voltage-controlled varactor 12 and output voltage-controlled varactor 26 have a phase difference of 90 degrees; the signal phase in a perturbing voltage-controlled varactor 48 respectively has a phase difference of 45 degrees with respect to the signal phases in the input voltage-controlled varactor 12 and the output voltage-controlled varactor 26; the signal phases in a perturbing voltage-controlled varactor 44 and the perturbing voltage-controlled varactor 48 have a phase difference of 180 degrees; the signal phase in a perturbing voltage-controlled varactor 42 has a phase difference of 45 degrees with respect to the signal phase in the input voltage-controlled varactor 12; the signal phase in the perturbing voltage-controlled varactor 46 has a phase difference of 45 degrees with respect to the signal phase in the output voltage-controlled varactor 26; and the signal phases in the perturbing voltage-controlled varactors 42 and 46 have a phase difference of 180 degrees. In the embodiments shown in FIG. 2(*m*), the perturbing voltage-controlled varactors are in series. In other words, two ends of each of the perturbing voltage-controlled varactors 42, 44, 46 and 48 are connected to the dual-mode ring resonator 16. Refer to FIG. 2(*n*), wherein the four perturbing voltage-controlled varactors 42, 44, 46 and 48 are in parallel, and wherein one end of each of the perturbing voltage-controlled varactors 42, 44, 46 and 48 is connected to the dual-mode ring resonator 16, and the other end of each of the perturbing voltage-controlled varactors 42, 44, 46 and 48 is grounded.

Refer to FIG. 1 again. External signals are received by the signal input electrode 10 and processed by the input voltage-controlled varactor 12, the dual-mode ring resonator 16 and the output voltage-controlled varactor 26 and then output from the signal output electrode 28 as filtered signals. With all the varactors controlled by the two voltage sources 14 and 24, the two perturbing voltage-controlled varactors 20 are modulated to separate or combine the odd mode and even mode of the signals in the dual-mode ring resonator 16. When none perturbation effect exists, i.e. when the dual-mode ring resonator 16 resonates and the two perturbing voltage-controlled varactors 20 resonate also, the phase velocities of the odd mode and even mode of a signal are identical, and the phases thereof are counterbalanced in the signal output electrode 28, and the bandstop response is thus formed. When there is a capacitive perturbation, i.e. when the dual-mode ring resonator 16 resonates and the two perturbing voltage-controlled varactors 20 become capacitive, the phase velocities of the odd mode and even mode of a signal are different, and the phases thereof are out of phase in the signal output electrode 28; thus, the bandpass response is formed, and two zero-transmission points are created beside the bandpass.

When two voltage sources 14 and 24 control two perturbing voltage-controlled varactors 20 to form two different responses, the center frequencies of the two responses are not identical. The center frequencies of the two responses are expressed by the following two equations:

$$f_{c,BP}=f_u\{1-(1/\pi)\tan^{-1}(x_S/2)+(1/2\pi)[x_F/(1+x_F^2)]Z_R/Z_O\}$$

$$f_{c,BS}=f_u\{1+(1/2\pi)[x_F/(1+x_F^2)]Z_R/Z_O\}$$

wherein $f_u$ is the resonance frequency of the unperturbed ring resonator, $x_S$ the normalized reactance of the perturbing varactor, $x_F$ the normalized reactance of the feeding varactor, $Z_R$ the ring characteristic impedance, and $Z_O$ the port impedance. The problem of frequency shift can be improved via modulating the input voltage-controlled varactor 12 and the output voltage-controlled varactor 26 according to the following equation:

$$x_{F,BS}=2\left[1-\sqrt{1-4\left(\frac{x_{F,BP}}{1+x_{F,BP}^2}-2\frac{Z_o}{Z_R}\tan^{-1}\frac{x_S}{2}\right)^2}\right]\times\left(\frac{x_{F,BP}}{1+x_{F,BP}^2}-2\frac{Z_o}{Z_R}\tan^{-1}\frac{x_S}{2}\right)^{-1}$$

Figure 3A:
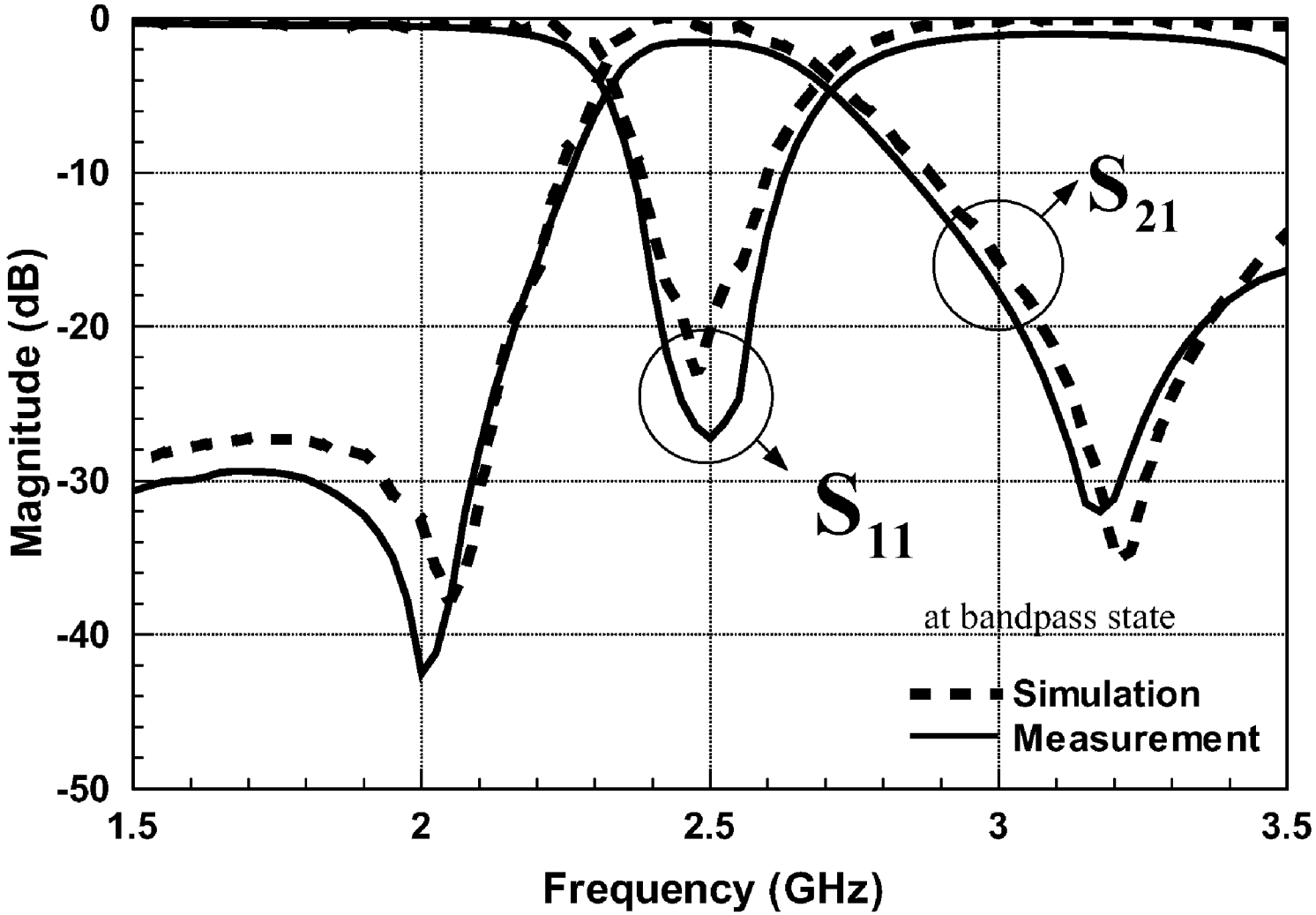
FIG. 3(*a*) and FIG. 3(*b*) are diagrams showing the simulation results and measurement results of the switchable frequency response microwave filter according to the present invention.
Figure 3B:
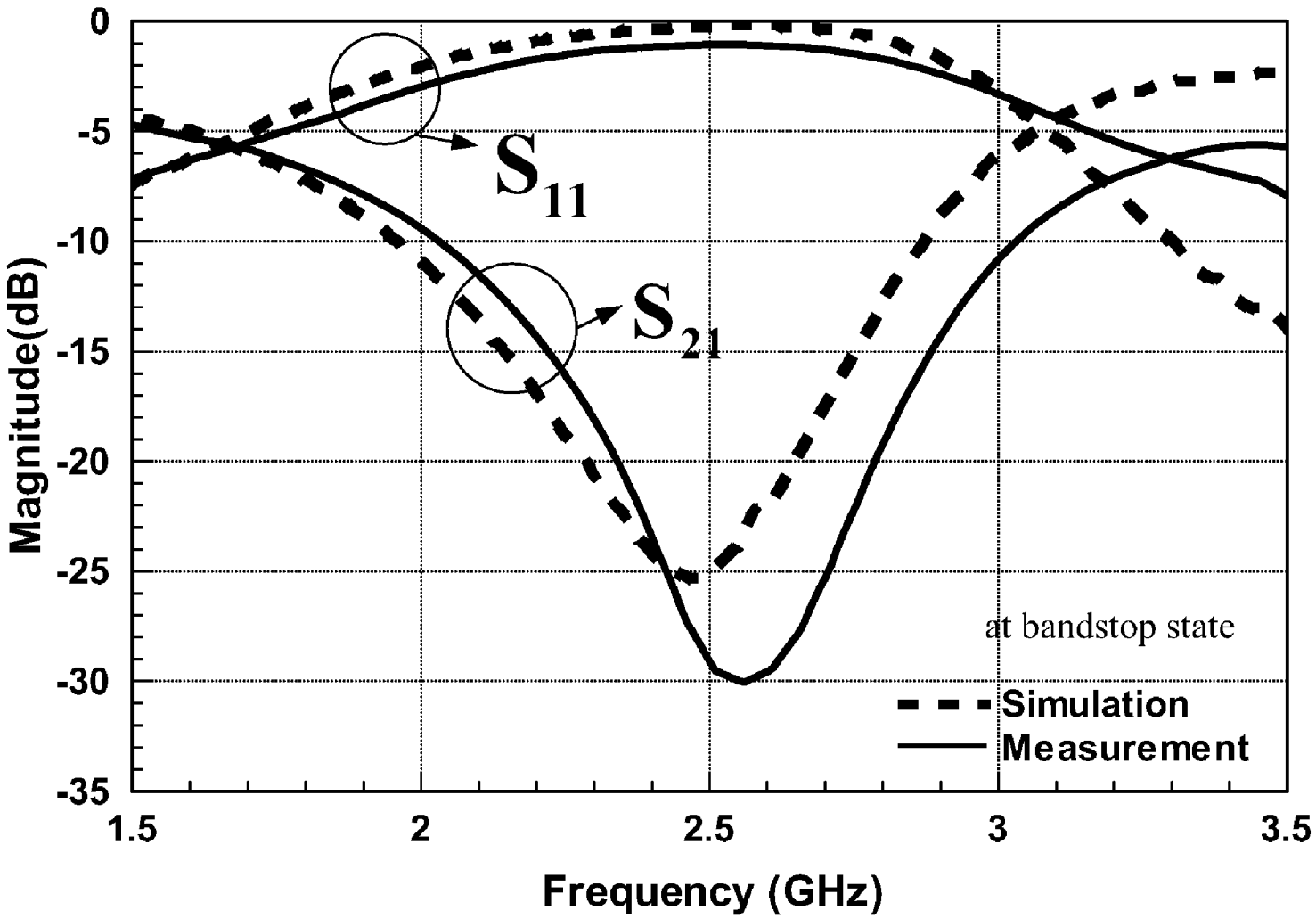

Refer to FIG. 3(*a*) and FIG. 3(*b*) diagrams showing the simulation results and measurement results of the switchable frequency response microwave filter of the present invention, wherein S11 denotes the return loss, and S21 denotes the insertion loss. In the diagram showing the simulation results and measurement results of the switchable frequency response microwave filter in the bandpass state, the insertion loss is very small at the center frequency, and the return loss is very great at the center frequency, which means the power of the microwave having the center frequency can propagate. In the diagram showing the simulation results and measurement results of the switchable frequency response microwave filter in the bandstop state, the insertion loss is very great at the center frequency, and the return loss is very small at the center frequency, which means the power of the microwave having the center frequency cannot propagate.

In conclusion, the present invention can switch between a bandpass frequency response and a bandstop frequency response without totally replacing the circuit architecture. Further, the present invention integrates both circuit architectures of a bandpass filter and a bandstop filter into a single circuit to decrease circuit complexity and reduce circuit area. Besides, the present invention also proposes a detailed solution for center frequency shift. Therefore, the present invention will be of great usefulness.

The preferred embodiments described above are only to exemplify the present invention but not to limit the scope of the present invention. Therefore, any equivalent modification or variation according to the shapes, structures, characteristics and spirit disclosed in the present invention is to be also included within the scope of the present invention.

What is claimed is:

1. A switchable frequency response microwave filter, comprising:

a signal input electrode receiving an external signal, an input voltage-controlled varactor coupled to said signal input electrode and a first voltage source;

a dual-mode ring resonator coupled to said input voltage-controlled varactor, a grounding terminal and a second voltage source and receiving said external signal via said input voltage-controlled varactor;

an output voltage-controlled varactor coupled to said dual-mode ring resonator;

a set of perturbing voltage-controlled varactors respectively arranged in different positions of said dual-mode ring resonator; and a signal output electrode coupled to said output voltage-controlled varactor and said grounding terminal, wherein said output voltage-controlled varactor transfers said external signal from said dual-mode ring resonator to said signal output electrode to output a filtered signal, and wherein said first and second voltage sources are used to modulate said set of perturbing voltage-controlled varactors to control phase velocities of an even mode and an odd mode of said external signal in said dual-mode ring resonator.

2. The switchable frequency response microwave filter according to claim 1, wherein said dual-mode ring resonator is formed of a transmission line.

3. The switchable frequency response microwave filter according to claim 2, wherein said transmission line is a strip line, a microstrip line, two open conductive lines, a coaxial cable, a slotted line, a square waveguide, a round waveguide, or a coplanar waveguide.

4. The switchable frequency response microwave filter according to claim 1, wherein when said dual-mode ring resonator resonates and said set of perturbing voltage-controlled varactors becomes capacitive, said phase velocities of said odd mode and said even mode of said external signal are different, and a bandpass response is thus formed, and two zero-transmission points are respectively formed at two sides of the bandpass response.

5. The switchable frequency response microwave filter according to claim 1, wherein when said dual-mode ring resonator resonates and said set of perturbing voltage-controlled varactors also resonates, said phase velocities of said odd mode and said even mode of said external signal are identical, and a bandstop response is thus formed.

6. The switchable frequency response microwave filter according to claim 1, wherein signal phases in said input voltage-controlled varactor and said output voltage-controlled varactor have a phase difference of 90 degrees.

7. The switchable frequency response microwave filter according to claim 6, wherein said set of perturbing voltage-controlled varactors includes two perturbing voltage-controlled varactors.

8. The switchable frequency response microwave filter according to claim 7, wherein a signal phase in one of said two perturbing voltage-controlled varactors respectively has a phase difference of 45 degrees with respect to said signal phases in said input voltage-controlled varactor and said output voltage-controlled varactor; a signal phase in another of said two perturbing voltage-controlled varactors respectively has a phase difference of 135 degrees with respect to said signal phases of said input voltage-controlled varactor and said output voltage-controlled varactor; and said signal phases in said two perturbing voltage-controlled varactors have a phase difference of 180 degrees.

9. The switchable frequency response microwave filter according to claim 7, wherein a signal phase in one of said two perturbing voltage-controlled varactors has a phase difference of 45 degrees with respect to a signal phase in said input voltage-controlled varactor; said signal phase in another of said two perturbing voltage-controlled varactors has a phase difference of 45 degrees with respect to said signal phase of said output voltage-controlled varactor; and said signal phases in two said perturbing voltage-controlled varactors have a phase difference of 180 degrees.

10. The switchable frequency response microwave filter according to claim 6, wherein said set of perturbing voltage-controlled varactors includes a first perturbing voltage-controlled varactor, a second perturbing voltage-controlled varactor, a third perturbing voltage-controlled varactor and a fourth perturbing voltage-controlled varactor.

11. The switchable frequency response microwave filter according to claim 10, wherein a signal phase in said first perturbing voltage-controlled varactor respectively has a phase difference of 45 degrees with respect to said signal phases in said input voltage-controlled varactor and said output voltage-controlled varactor; said signal phases in said first perturbing voltage-controlled varactor and a signal phase in said second perturbing voltage-controlled varactor have a phase difference of 180 degrees; a signal phase in said third perturbing voltage-controlled varactor has a phase difference of 45 degrees with respect to said signal phase in said input voltage-controlled varactor; said signal phase in said fourth perturbing voltage-controlled varactor has a phase difference of 45 degrees with respect to said signal phase in said output voltage-controlled varactor; and said signal phases in said third perturbing voltage-controlled varactor and said fourth perturbing voltage-controlled varactor have a phase difference of 180 degrees.

12. The switchable frequency response microwave filter according to claim 6, wherein said set of perturbing voltage-controlled varactors includes a perturbing voltage-controlled varactor.

13. The switchable frequency response microwave filter according to claim 12, wherein a signal phase in said perturbing voltage-controlled varactor respectively has a phase difference of 45 or 135 degrees with respect to said signal phases in said input voltage-controlled varactor and said output voltage-controlled varactor.

14. The switchable frequency response microwave filter according to claim 6, wherein said set of perturbing voltage-controlled varactors includes a first perturbing voltage-controlled varactor, a second perturbing voltage-controlled varactor and a third perturbing voltage-controlled varactor.

15. The switchable frequency response microwave filter according to claim 14, wherein a signal phase in said first perturbing voltage-controlled varactor respectively has a phase difference of 45 degrees with respect to said signal phases in said input voltage-controlled varactor and said output voltage-controlled varactor; a signal phase in said second perturbing voltage-controlled varactor has a phase difference of 45 degrees with respect to said signal phase in said input voltage-controlled varactor; a signal phase in said third perturbing voltage-controlled varactor has a phase difference of 45 degrees with respect to said signal phase in said output voltage-controlled varactor; and said signal phases in said second perturbing voltage-controlled varactor and said third perturbing voltage-controlled varactor have a phase difference of 180 degrees.

16. The switchable frequency response microwave filter according to claim 14, wherein a signal phase in said first perturbing voltage-controlled varactor respectively has a phase difference of 135 degrees with respect to said signal phases in said input voltage-controlled varactor and said output voltage-controlled varactor; a signal phase in said second perturbing voltage-controlled varactor has a phase difference of 45 degrees with respect to a signal phase in said input voltage-controlled varactor; said signal phase in said third perturbing voltage-controlled varactor has a phase difference of 45 degrees with respect to said signal phase in said output voltage-controlled varactor; and said signal phases in said second perturbing voltage-controlled varactor and said third perturbing voltage-controlled varactor have a phase difference of 180 degrees.

17. The switchable frequency response microwave filter according to claim 7, wherein one end of each of said two perturbing voltage-controlled varactors is connected to said dual-mode ring resonator, and another end of each of said two perturbing voltage-controlled varactors is grounded, or both ends of each of said two perturbing voltage-controlled varactors are connected to said dual-mode ring resonator.

18. The switchable frequency response microwave filter according to claim 10, wherein one end of said first, second, third and fourth perturbing voltage-controlled varactors is connected to said dual-mode ring resonator, and another end of each said first, second, third and fourth perturbing voltage-controlled varactor is grounded, or both ends of each said first, second, third, and fourth perturbing voltage-controlled varactor are connected to said dual-mode ring resonator.

19. The switchable frequency response microwave filter according to claim 12, wherein one end of said perturbing voltage-controlled varactor is connected to said dual-mode ring resonator, and another end of said perturbing voltage-controlled varactor is grounded, or both ends of said perturbing voltage-controlled varactor are connected to said dual-mode ring resonator.

20. The switchable frequency response microwave filter according to claim 14, wherein one end of each said first, second, and third perturbing voltage-controlled varactor is connected to said dual-mode ring resonator, and another end of each said first, second, and third perturbing voltage-controlled varactor is grounded, or both ends of each said first, second, and third perturbing voltage-controlled varactor are connected to said dual-mode ring resonator.

* * * * *